US008139778B2

(12) United States Patent
Barthel et al.

(10) Patent No.: US 8,139,778 B2
(45) Date of Patent: Mar. 20, 2012

(54) METHOD FOR THE TIME-CONTROLLED ADJUSTMENT OF A HEARING APPARATUS AND CORRESPONDING HEARING APPARATUS

(75) Inventors: Roland Barthel, Erlangen (DE); Robert Bäuml, Eckental (DE); Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1165 days.

(21) Appl. No.: 11/904,412

(22) Filed: Sep. 27, 2007

(65) Prior Publication Data

US 2008/0226105 A1 Sep. 18, 2008

(30) Foreign Application Priority Data

Sep. 29, 2006 (DE) ..... 10 2006 046 230

(51) Int. Cl.
*H04R 29/00* (2006.01)

(52) U.S. Cl. ..... 381/60; 381/312; 381/314; 381/318; 600/25; 607/55; 607/57

(58) Field of Classification Search ..... 381/312, 381/318, 314, 60; 600/25; 607/55, 57
See application file for complete search history.

(56) References Cited

U.S. PATENT DOCUMENTS

| | | | | |
|---|---|---|---|---|
| 2005/0129262 | A1 | 6/2005 | Dillon et al. | |
| 2006/0215860 | A1 | 9/2006 | Wyrsch | |
| 2006/0222194 | A1 * | 10/2006 | Bramslow et al. | 381/314 |

FOREIGN PATENT DOCUMENTS

| | | | |
|---|---|---|---|
| DE | 1617705 | A2 | 1/2006 |
| EP | 0814634 | | 12/1997 |
| EP | 1453357 | | 9/2004 |
| EP | 1699262 | A2 | 9/2006 |
| WO | 2004056154 | A2 | 7/2004 |
| WO | 2004114722 | | 12/2004 |

* cited by examiner

*Primary Examiner* — Steven Loke
*Assistant Examiner* — Cuong Nguyen

(57) ABSTRACT

The training of a hearing apparatus in respect of an individual adjustment is to be developed in a more user-friendly manner. To this end, provision is firstly made to automatically classify a hearing situation, to adjust a parameter of the signal processing facility of the hearing apparatus and to automatically learn the adjusted parameters for the current hearing situation. A temporal monitoring of the steps "classifying" and "adjusting" is however carried out here and the automatic learning is only triggered if the classified hearing situation and the adjustment of the parameters have not changed over a predetermined time period. This not only simplifies the training, but also enables a more rapid training by means of automatically triggered training events.

4 Claims, 1 Drawing Sheet

METHOD FOR THE TIME-CONTROLLED ADJUSTMENT OF A HEARING APPARATUS AND CORRESPONDING HEARING APPARATUS

CROSS REFERENCE TO RELATED APPLICATIONS

This application claims priority of German application No. 10 2006 046 230.0 filed Sep. 29, 2006, which is incorporated by reference herein in its entirety.

FIELD OF THE INVENTION

The present invention relates to a method for adjusting a hearing apparatus by automatically classifying a hearing situation, manually adjusting a parameter of a signal processing facility of the hearing apparatus and automatically learning the adjusted parameter for the current hearing situation. Furthermore, the present invention relates to a corresponding hearing apparatus. The term hearing apparatus is understood here to mean any portable and non-portable device for acoustic communication, in particular a hearing device, a head set and earphones.

BACKGROUND OF THE INVENTION

Hearing devices are portable hearing apparatuses which are used to supply the hard-of-hearing. To accommodate the numerous individual requirements, different configurations of hearing devices such as behind-the-ear hearing devices (BTE), in-the-ear hearing devices (ITE), concha hearing devices, are provided. The hearing devices designed by way of example are worn on the outer ear or in the auditory canal. Furthermore, bone conduction hearing aids, implantable or vibrotactile hearing aids are also available on the market. The damaged hearing is herewith either stimulated mechanically or electrically.

Essential components of the hearing devices include in principal an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This main configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is provided by a battery 5 which is likewise integrated into the hearing device housing 1.

The large number of parameters in a hearing device signal processing and the similarly large number of the most varied hearing situations as well as the subjective hearing sensitivity of a hearing device wearer require an individual adjustment of the hearing device parameters to the individual and the corresponding situation. As a detailed adjustment is not possible in a special situation in a short adjustment session, it is useful if the user is able to express their views on a preferred adjustment when he/she desires a change. This is achieved by means of training, by the user specifying a desired hearing experience by way of program selector switches and volume control. The device memorizes this in order to behave as desired the next time this situation occurs.

There is nevertheless uncertainty as to when and for how long this desired hearing experience is valid. It is also questionable whether and when another change is to be expected. By way of example, it is not known whether the current desired hearing experience relates to an instant (e.g. the slamming of a door was perceived as too loud) or to the last five minutes.

In current approaches for training hearing device-specific parameters, it is always presupposed that the user informs the hearing system as to whether his/her decision is "final". In this context, the publication US 2005/0129262 A1 discloses a hearing device which can be automatically adjusted and trained to the acoustic situations. A so-called "vote" button is to be activated there in order to complete one learning step. A button activation of this type can possibly be very laborious or easily forgotten.

SUMMARY OF THE INVENTION

The object of the present invention thus consists in developing the training of a hearing apparatus in a more user-friendly fashion.

In accordance with the invention, this object is achieved by a method for adjusting a hearing apparatus by automatically classifying a hearing situation, adjusting a parameter of a signal processing facility of the hearing apparatus and automatically learning the adjusted parameter for the current hearings situation, as well as temporally monitoring the steps "classifying" and "adjusting" and only triggering the automatic learning when the classified hearing situation and the adjustment have not modified a predetermined time period.

Furthermore, provision is made in accordance with the invention for a hearing apparatus with a classification facility for classifying a hearing situation, a signal processing facility, which is connected to the classification facility, an adjustment facility for adjusting a parameter of the signal processing facility, a learning facility for automatically learning the adjusted parameter for the current hearing situation, and a time monitoring facility for temporally monitoring the classification facility and the adjustment facility as well as for triggering an automatic learning of the learning facility, as soon as the classified hearing situation and the adjustment have not changed a predetermined time period.

The invention thus advantageously provides a simplified operational concept for hearing apparatuses and in particular hearing devices. The operation of the device is simplified as a result of the device learning and thereby improving its adjustments, without the user always having to think of pressing a "vote" button in situations in which he is happy. A further advantage of the concept according to the invention lies in the fact that more training units can be achieved. Significantly more training events are herewith be achieved as a result namely of the device attempting to learn after each user modification. The start adjustment thus converges more rapidly with the desired adjustments. This in turn results in faster training, because the user identifies earlier, by virtue of more frequent training events, that the device optimizes its adjustments itself. After some time, modifications by the user are no longer necessary as a result of the desired adjustment being achieved rapidly. A higher user acceptance can subsequently by achieved because the device adjusts rapidly and in an uncomplicated fashion to the individual hearing impression of the user.

An average value and/or a variance of a level is preferably analyzed with the automatic classification. Such an examination makes it possible to determine for instance whether the respective situation is clear or whether particular events have taken place of late. If the situation was not clear and particular events have optionally occurred, no step is carried out for the relevant time period. Instead, the learning process only starts after the hearing situation has been clearly determined.

In the event of a binaural supply, it is particularly advantageous if differences between the supply of the left ear and of the right ear are analyzed during the automatic classification. Information from the binaural supply can thus also be used for the automatic training.

BRIEF DESCRIPTION OF THE DRAWINGS

The present invention is described in more detail with reference to the appended drawings, in which.

DETAILED DESCRIPTION OF THE INVENTION

The exemplary embodiment illustrated in more detail below represents a preferred embodiment of the present invention.

Figure 1:
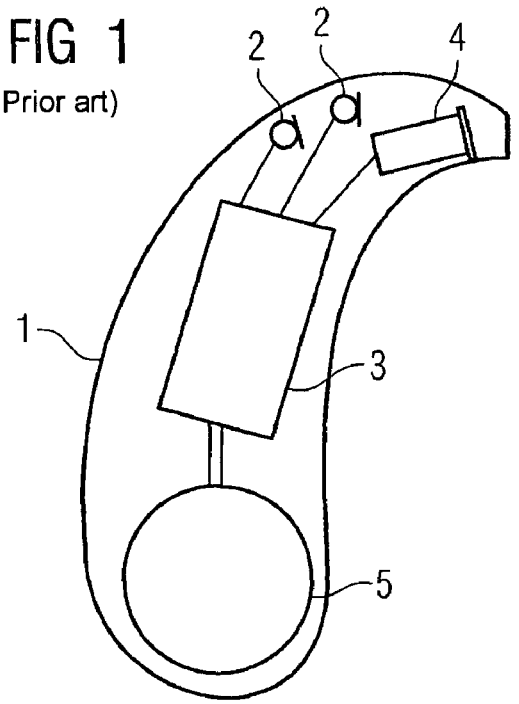
FIG 1 (Prior art)
FIG. 1 shows the schematic design of a hearing device.
Figure 2:
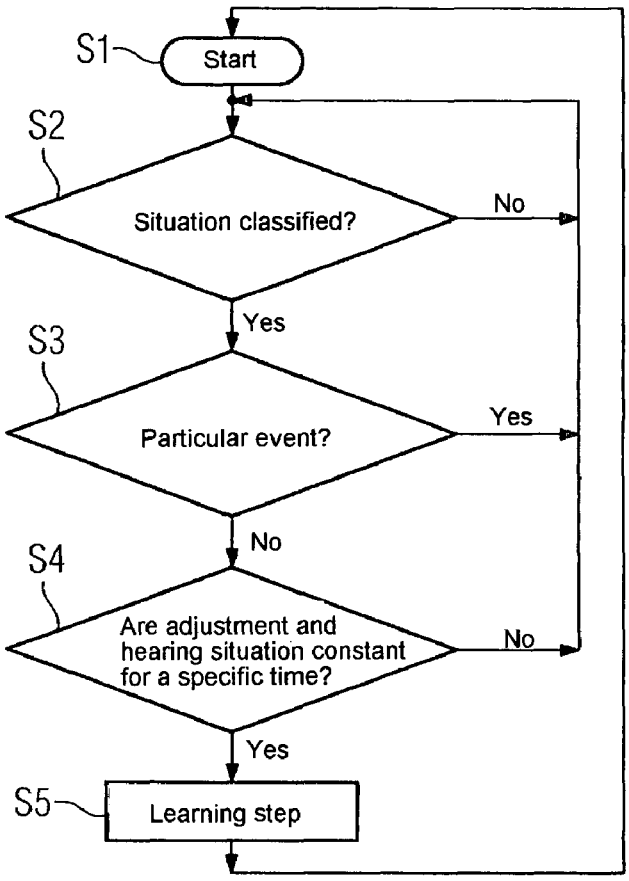
FIG. 2 shows a flow diagram of the method according to the invention.

A method for adjusting a hearing apparatus is carried out by way of example according to the flow diagram in FIG. 2. The adjustment is carried out by means of automatic learning. This learning is started in step S1. Start triggers can consist of a manual adjustment of the hearing apparatus and/or the hearing device. A modified hearing situation can likewise be used as a start trigger. Step S2 then firstly monitors whether the current hearing situation could be clearly classified. If this is not the case, classification step S2 is repeated accordingly often. In the case of a clear classification, it is possible to additionally monitor according to step S3 whether particular acoustic events have occurred. If the answer is "yes", the classification of the hearing situation is possibly not significant and the method returns to classification step S2.

If, on the other hand, the hearing situation is classified clearly and no particular acoustic event has taken place, step S4 monitors whether the adjustment of the hearing apparatus and the hearing situation were constant for a certain amount of time. This monitoring time period can be predetermined in any fashion. While the end of the monitoring time period is not achieved, the system returns to step S2 and repeatedly monitors the classification and the presence of particular acoustic events.

If the adjustment and hearing situation are finally constant for the predetermined time period, step S5 is performed. In this step, the adjustment of the hearing device and/or of the hearing apparatus to the classified hearing situation is stored. After step S5, the system automatically reverts back again to the starting point in step S1. A further modification to the adjustment or a situation change can thus initiate a further step.

The automatic training of the hearing apparatus is subsequently shown again from the user's perspective.

According to the inventive solution, the "vote" button known from the prior art is replaced by a temporal controller. To this end, as was already just indicated with reference to FIG. 2, user behavior is analyzed and modifications to the situation are registered. If the situation is clear and/or if there are no particular events of late (deviations from the average value or the variance of the level, binaurally no large differences or suchlike), and the user retains the selected adjustment for a while, the desired hearing experience for this situation appears to be valid and is trained. If the environmental parameters, i.e. the hearing situation, have changed, the desired hearing experience cannot be viewed as generally valid and is not trained. If the user has carried out a further change to the adjustment, the observation time period is extended before the training event, i.e. the step, is triggered.

The invention claimed is:

1. A method for adjusting a hearing apparatus, comprising:

automatically classifying a hearing situation;

adjusting a parameter of a signal processing unit of the hearing apparatus;

temporally monitoring the classification and the adjustment;

automatically learning the adjusted parameter for the hearing situation only if the classified hearing situation and the adjustment have not changed in a predetermined time period; and analyzing an average value or a variance of a level of the hearing situation during the automatic classification and wherein no automatically learning is performed if the classification of the hearing situation is not significant.

2. The method as claimed in claim 1, wherein a difference between a supply of a left ear and a right ear of a user of the hearing apparatus is analyzed during the automatic classification.

3. A hearing apparatus, comprising:

a classification unit that classifies a hearing situation, wherein the classification unit analyzes an average value or a variance of a level of the hearing situation and classifies the hearing situation based on the analysis;

an adjustment unit that adjusts a parameter of a signal processing unit of the hearing apparatus;

a learning unit that automatically learns the adjusted parameter for the hearing situation, wherein the learning unit does not perform the automatically learning if the classification of the hearing situation is not significant; and a time monitoring unit that temporally monitors the classification unit and the adjustment unit and triggers an automatic learning of the learning unit once the classified hearing situation and the adjustment have not changed in a predetermined time period.

4. The hearing apparatus as claimed in claim 3, wherein the classification unit analyzes a distinction between a supply of a left ear and a right ear of a user of the hearing apparatus and classifies the hearing situation based on the analysis.

* * * * *